US007000424B2

(12) United States Patent
Matsumoto et al.

(10) Patent No.: US 7,000,424 B2
(45) Date of Patent: Feb. 21, 2006

(54) REFRIGERANT CYCLING DEVICE

(75) Inventors: Kenzo Matsumoto, Oizumi-machi (JP); Masaji Yamanaka, Tatebayashi (JP); Haruhisa Yamasaki, Oizumi-machi (JP); Kazuya Sato, Oizumi-machi (JP); Kentaro Yamaguchi, Oizumi-machi (JP); Kazuaki Fujiwara, Ota (JP); Akifumi Tomiuka, Isesaki (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/683,758

(22) Filed: Oct. 9, 2003

(65) Prior Publication Data

US 2004/0107720 A1 Jun. 10, 2004

(30) Foreign Application Priority Data

Dec. 5, 2002 (JP) ..... 2002-353824

(51) Int. Cl.

| | |
|---|---|
| ***F25B 13/00*** | (2006.01) |
| ***F04B 23/00*** | (2006.01) |
| ***F04B 17/00*** | (2006.01) |
| ***F04C 18/00*** | (2006.01) |
| ***F01C 21/04*** | (2006.01) |

(52) U.S. Cl. ..... 62/324.6; 417/313; 417/410.3; 417/243; 417/251; 418/60; 418/83

(58) Field of Classification Search ..... 62/324.6, 62/196.2; 418/7, 8, 60, 83; 417/251, 243, 417/313, 410.3

See application file for complete search history.

(56) References Cited

U.S. PATENT DOCUMENTS

| | | | | |
|---|---|---|---|---|
| 4,009,573 | A * | 3/1977 | Satz | 60/519 |
| 4,262,492 | A * | 4/1981 | Morita et al. | 62/324.6 |
| 4,644,760 | A * | 2/1987 | Aoki et al. | 62/324.6 |
| 5,885,060 | A * | 3/1999 | Cunkelman et al. | 417/243 |
| 6,189,335 | B1 * | 2/2001 | Ebara et al. | 62/510 |
| 6,467,296 | B1 * | 10/2002 | Fujii et al. | 62/324.6 |
| 6,516,623 | B1 * | 2/2003 | Collier | 62/238.7 |

FOREIGN PATENT DOCUMENTS

| | | | |
|---|---|---|---|
| JP | 043413647 A | * | 11/1992 |
| JP | 6-33886 | * | 8/1994 |

* cited by examiner

*Primary Examiner*—Cheryl Tyler
*Assistant Examiner*—Filip Zec
(74) *Attorney, Agent, or Firm*—J.C. Patents

(57) ABSTRACT

A refrigerant cycling device is provided. The refrigerant cycling device comprises a compressor, an intermediate cooling circuit and a three-way valve device. The compressor is connected to a heat exchanger and a depressurizing means, for performing a cooling operation and a heating operation. The compressor further comprises a first and a second rotary compression elements within a sealed container, and a refrigerant that is compressed and discharged by the first rotary compression element is introduced to the second rotary compression element. The intermediate cooling circuit is used for radiating heat of the refrigerant discharged from the first rotary compression element. The three-way valve device for opening a passage of the intermediate cooling circuit during the cooling operation. In this way, the coefficient of production (COP) during the cooling operation can be improved.

3 Claims, 2 Drawing Sheets

REFRIGERANT CYCLING DEVICE

CROSS-REFERENCE TO RELATED APPLICATION

This application claims the priority benefit of Japanese application serial no. 2002-353824, filed on Dec. 5, 2002.

BACKGROUND OF THE INVENTION

1. Field of the Invention

This invention relates in general to a refrigerant cycling device. More particularly, the present invention relates to a refrigerant cycling device whose high-pressure side possesses a hyper critical pressure.

2. Description of the Related Art

In a conventional refrigerant cycling device, e.g., a refrigerant cycling device equipped in an air conditioner, by switching a four-way valve (used as a flow passage switching means), the refrigerant discharged from the compressor passes goes through the four-way valve, and then gets discharged to an outdoor heat exchanger (a heat exchanger at the heat source side) during an air conditioning operation (a cooling operation). After the refrigerant radiates heat at the outdoor heat exchanger, the refrigerant is throttled by a depressurizing means to supply to an indoor heat exchanger (a heat exchanger at the user side) where the refrigerant evaporates. At this time, the refrigerant absorbs heat from the ambient environment to effectuate a cooling effect to cool the interior of the room. Thereafter, the refrigerant passes through the four-way valve and returns back to the compressor. The aforementioned cycle is repeatedly processed. On the other hand, the refrigerant discharged from the compressor passes through the four-way valve, and gets discharged to the indoor heat exchanger (a heat exchanger at the user side) during a heating operation. The refrigerant radiates heat at the indoor heat exchanger. At this time, the refrigerant radiates heat to the ambient environment to heat the interior of the room. Thereafter, the refrigerant is throttled by the depressurizing means and discharged to the outdoor heat exchanger (the heat exchanger at the heat source side). After the refrigerant absorbs heat from the ambient environment at the outdoor heat exchanger, the refrigerant goes through the four-way valve, and then returns back to the compressor. The aforementioned cycle is repeatedly processed.

In addition, for addressing the global environment issues in recent years, such refrigerant cycling device does not use the Freon type refrigerant, and a refrigerant cycling device, in which a natural refrigerant (e.g., carbon oxide, $CO_2$) is used as the refrigerant, is developed.

When the high-pressure side is operated under a hyper critical pressure, it is generally known that the heating efficiency is obviously improved in a heating operation.

However, when the high-pressure side is operated under the hyper critical pressure, a coefficient of product (COP) in an air-conditioning operation is very worse. Therefore, for increasing the cooling capability, a large amount of refrigerant is required and that will cause a problem of increasing power consumption of the compressor, etc.

SUMMARY OF THE INVENTION

According to the foregoing description, an object of this invention is to provide a refrigerant cycling device capable of improving the COP of the air-conditioning operation.

According to the object(s) mentioned above, the present invention provides a refrigerant cycling device, comprising a compressor, an intermediate cooling circuit and a valve device. The compressor is connected to a heat exchanger and a depressurizing means, for performing a cooling operation and a heating operation. The compressor further comprises a first and a second rotary compression elements, and a refrigerant that is compressed and discharged by the first rotary compression element is introduced to the second rotary compression element. The intermediate cooling circuit is used for radiating heat of the refrigerant discharged from the first rotary compression element. The valve device for opening a passage of the intermediate cooling circuit during the cooling operation. According to the above configuration, during an air-conditioning (cooling) operation, heat of the refrigerant discharged from the first rotary compression element is radiated at the intermediate cooling circuit, to achieve a cooling effect. In this manner, the temperature in the sealed container can be suppressed from rising.

In the above refrigerant cycling device, the heat exchanger is constructed by a first heat exchanger at a user side and a second heat exchanger at a heat source side. The refrigerant cycling device further comprises an internal heat exchanger for cycling the refrigerant discharged from the first rotary compression element through the second heat exchanger at a heat source side, the depressurizing means and the first heat exchanger at a user side during the cooling operation, and for cycling the refrigerant discharged from the compressor through the first heat exchanger at a user side, the depressurizing means and the second heat exchanger at a heat source side during the heating operation, so as to perform a heat exchange between the refrigerant flowing between the depressurizing means and the second heat exchanger at a heat source side and the refrigerant flowing between the compressor and the first heat exchanger at a user side. In this way, the temperature of the refrigerant can be further reduced.

In addition, since carbon oxide is used as the refrigerant, the refrigerant cycling device of the present invention can provide contribution for solving environment issues.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

DESCRIPTION OF THE PREFERRED EMBODIMENT

Figure 1:
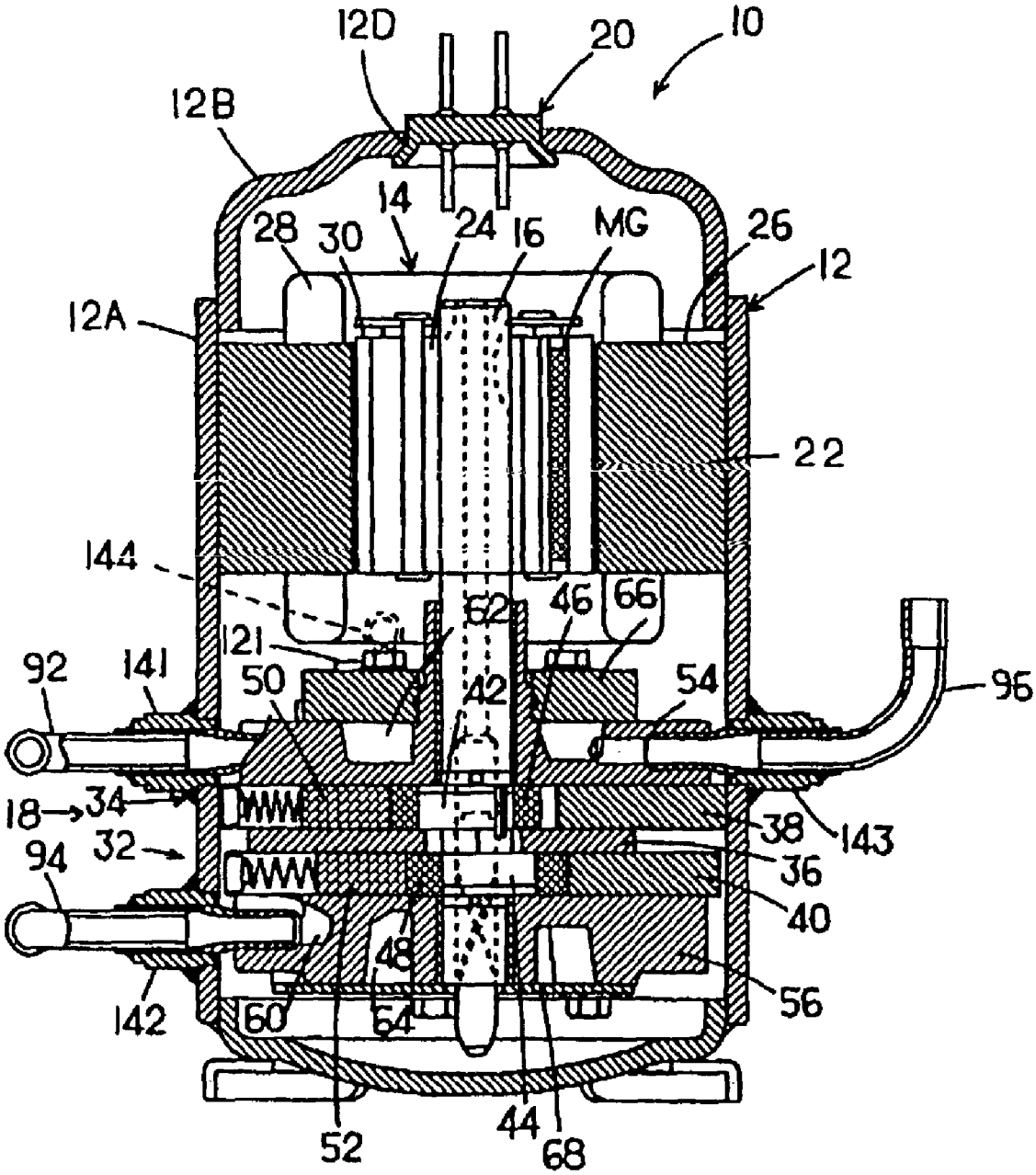
FIG. 1 is a vertical cross-sectional view of an internal intermediate pressure multi-stage compression type rotary compressor that forms a part of a refrigerant cycling device of the present invention.
Figure 2:
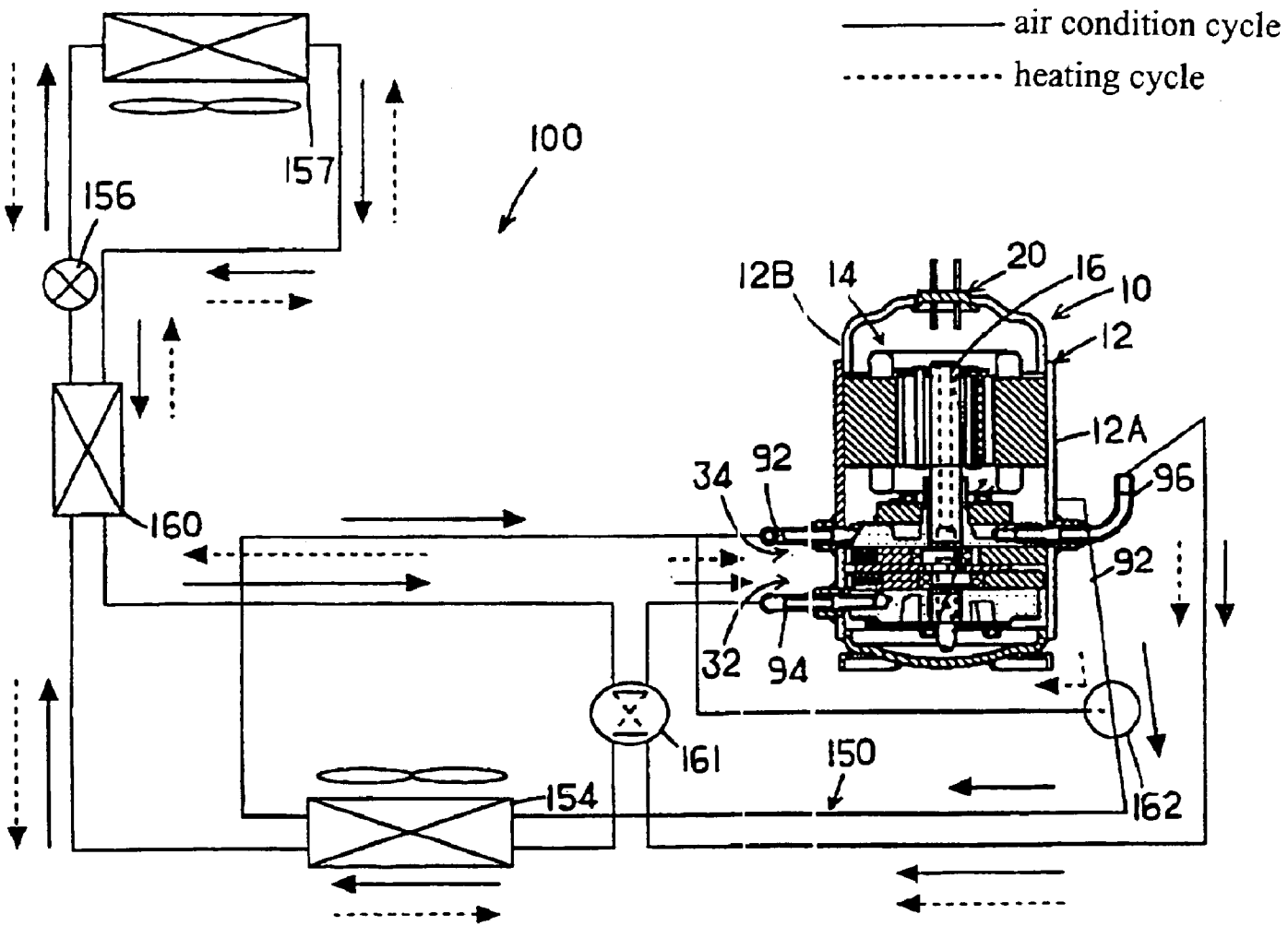
FIG. 2 is a refrigerant cycling circuit according to the present invention.

Embodiments of the present invention are described in detail according to attached drawings. FIG. 1 is a vertical cross-sectional view showing an exemplary compressor used in a refrigerant cycling device of the present invention, wherein the compressor is an internal intermediate pressure multistage (e.g., two stages) compression type rotary compressor that comprises a first and a second rotary compression elements. FIG. 2 shows a refrigerant circuit of a refrigerant cycling device of the present invention, which is suitable for an air conditioner for air-conditioning and heating an interior space. In addition, the refrigerant cycling device can be also applied to vending machines, or devices capable of cooling and heating operations, such as showcases and cooling/heating chambers, etc.

In the drawings, an internal intermediate pressure type multi-stage compression rotary compressor (compressor, hereinafter) 10 comprises a cylindrical sealed container 12 made of steel plate, an electrical motor element 14 and a rotary compression mechanism 18. The electrical motor element 14 is arranged to be accommodated at the upper side of the sealed container 12, and is used as a driving element. The rotary compression mechanism 18 is arranged under the electrical motor element 14, and comprises a first rotary compression element 32 (the first stage) and a second rotary compression element 34 (the second stage) both of which are driven by a rotational shaft 16 of the electrical motor element 14.

The bottom part of the sealed container 12 serves as an oil accumulator, and the sealed container 12 is constructed by a container main body 12A and an end cap 12B. The container main body 12A is used to contain the electrical motor element 14 and the rotary compression mechanism 18. The end cap 12B is substantially a bowl shape for blocking an upper opening of the container main body 12A. A circular installation hole 12D is further formed at the center of the upper surface of the end cap 12B, and a terminal (wirings are omitted) 20 are installed into the installation hole 12D for providing power to the electrical motor element 14.

The electrical motor element 14 is a DC (direct current) motor of a so-called magnetic-pole concentrated winding type, and comprises a stator 22 and a rotor 24. The stator 22 is annularly installed along an inner circumference of an upper space of the sealed container 12, and the rotor 24 is inserted into the stator 22 with a slight gap. The rotor 24 is affixed onto the rotational shaft 16 that passes the center and extends vertically. The stator 22 comprises a laminate 26 formed by doughnut-shaped electromagnetic steel plates and a stator coil 28 that is wound onto tooth parts of the laminate 26 in a series (concentrated) winding manner. Additionally, similar to the stator 22, the rotor 24 is also formed by a laminate 30 of electromagnetic steel plates, and a permanent magnet MG is inserted into the laminate 30.

An intermediate partition plate 36 is sandwiched between the first rotary compression element 32 and the second rotary compression element 34. Namely, the first rotary compression element 32 and the second rotary compression element 34 are constructed by the intermediate partition plate 36, an upper and a lower cylinders 38, 40, an upper and a lower roller 46, 48, valves 50, 52, and an upper and a lower supporting members 54, 56. The upper and the lower cylinders 38, 40 are respectively arranged above and under the intermediate partition plate 36. The upper and the lower roller 46, 48 are eccentrically rotated by an upper and a lower eccentric parts 42, 44 that are set on the rotational shaft 16 with a phase difference of 180° in the upper and the lower cylinders 38, 40. The valves 50, 52 are in contact with the upper and the lower roller 46, 48 to divide the upper and the lower cylinders 38, 40 respectively into a low pressure chamber and a high pressure chamber. The upper and the lower supporting members 54, 56 are used to block an open surface at the upper side of the upper cylinder 38 and an open surface at the lower side of the lower cylinder 40, and are also used as a bearing of the rotational shaft 16.

In addition, absorption passages 60 (the upper one is not shown) for respectively connecting to interior of the upper and the lower cylinders 38, 40 by absorbing ports (not shown) and discharging muffler chambers 62, 64 are formed in the upper and the lower supporting members 54, 56. A portion of the upper supporting member 54 and a portion of the lower supporting member 56 are recessed, and the recessed portions are respectively blocked by an upper cover 66 and a lower covers 68 to form the discharging muffler chambers 62, 64.

Further, the discharging muffler chamber 64 and the interior of the sealed container 12 is connected by a connection passage that connects the upper, the lower cylinders 38, 40 and the intermediate partition plate 36. An intermediate discharging pipe 121 is formed to stand on the upper end of the connection passage. The intermediate pressure refrigerant gas, compressed by the first rotary compression element 32, is discharged from the intermediate discharging pipe 121 into the sealed container 12.

In addition, the sleeves 141, 142, 143 and 144 are fused to fix on the side face of the main body 12A of the sealed container 12 at positions corresponding to the absorption passages 60 (the upper one is not shown and numbered) of the upper supporting member 54 and the lower supporting member 56, the discharging muffler chamber 62 and the upper side of the upper cover 66 (substantially corresponding to the lower end of the electric motor element 14). One end of the refrigerant introduction pipe 92 for introducing the refrigerant gas to the upper cylinder 38 is inserted into the sleeve 141, and that inserted end of the refrigerant introduction pipe 92 is connected to an absorption passage (not shown) of the upper cylinder 38. The refrigerant introduction pipe 92 passes through an outdoor heat exchanger 154 (a heat exchanger at the heat source side) arranged on the intermediate cooling circuit 150, and then reaches the sleeve 144, while the other end of the refrigerant introduction pipe 92 is inserted into the sleeve 144 to connect to the interior of the sealed container 12.

In addition, one end of the refrigerant introduction pipe 94 for introducing the refrigerant gas into the lower cylinder 40 is inserted to connect to the sleeve 142, and that inserted end of the refrigerant introduction pipe 94 is connect to the absorption passage 60 of the lower cylinder 40. Further, the refrigerant discharging pipe 96 is inserted to connect to the sleeve 143, and one end of the refrigerant discharging pipe 96 is connected to the discharging muffler chamber 62.

In FIG. 2, the air conditioner 100 comprises an indoor module (not shown) that is arranged for air-conditioning the indoor space, and an outdoor module (not shown) that is placed outdoors. An indoor heat exchanger 154, used as a heat exchanger at the user side, is built in the indoor module. In addition, the embodiment is described using carbon oxide as the refrigerant.

In the outdoor module, the aforementioned compressor 10 used as means for circulating the refrigerant, a three-way valve 161 used as a valve device for opening the flow passage of the aforementioned intermediate cooling circuit 150 in the air-condition operation, a four-way valve used as means for switching the a flow passage, the outdoor heat exchanger 154, an internal heat exchanger 160, and an expansion valve 156 used as a depressurizing means, etc. are arranged. In addition, the intermediate cooling circuit 150 is used to radiate heat of the refrigerant that is compressed by the first rotary compression element 32 and discharged into the sealed container 12. A portion of the intermediate cooling circuit 150 is formed so as to pass through the outdoor heat exchanger 154.

The refrigerant discharging pipe 96 of the compressor 10 is connected to the outdoor heat exchanger 154 with pipes through the four-way valve 161. A pipe coming out of the outdoor heat exchanger 154 passes the internal heat exchanger 160 where the refrigerant flows between the outdoor heat exchanger 154 and the expansion valve 156 exchanges heat with the refrigerant that flows between the indoor heat exchanger 157 and the compressor 10.

A pipe coming out of the internal heat exchanger 160 is connected to the indoor heat exchanger 157 through the expansion valve 156. A pipe coming out of the indoor heat exchanger 157 passes through the internal heat exchanger 160, and then connected to the refrigerant introduction pipe 94 through the four-way valve 161.

Next, the operation of the refrigerant cycling device with the above configuration is described in detail as follows. During the air condition operation, the four-way valve 161 and the three-way valve 162 are switched by a control device (not shown) to positions as indicated by the solid lines, and the refrigerant flows as indicated by the solid lines in FIG. 2. As the stator coil 28 of the electrical motor element 14 is electrified through the wires (not shown) and the terminal 20, the electrical motor element 14 starts to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port (not shown) into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior of the sealed container 12 becomes intermediate pressure.

The intermediate pressure refrigerant gas inside the sealed container 12 enters the refrigerant introduction pipe 92, releases from the sleeve 144, and then flows into the intermediate cooling circuit 150 from the three-way valve 162 as indicated by solid line in FIG. 2. In the process where the intermediate cooling circuit 150 passes through the outdoor heat exchanger 154, heat is radiated in an air cooling manner. Therefore, because a cooling operation can be effectively achieved at the outdoor heat exchanger 154 by making the intermediate pressure refrigerant gas that is compressed by the first rotary compression element 32 to pass through the intermediate cooling circuit 150, the temperature in the sealed container 12 can be suppressed from rising and the compression efficiency of the second rotary compression element 34 can be improved.

The refrigerant gas absorbed into the second rotary compression element 34 is cooled by the outdoor heat exchanger 154 of the intermediate cooling circuit 150, and in this manner, the temperature of the refrigerant that is compressed and discharged by the second rotary compression element 34 can be suppressed from rising.

Therefore, since a supercooling degree of the refrigerant before reaching the expansion valve 156 becomes large, the air condition capability (the cooling capability) of the refrigerant gas at the indoor heat exchanger 157 can be improved. Furthermore, a desired evaporation temperature can be easily achieved without increasing a refrigerant cycling amount, and a reduction in the power consumption of the compressor can be made. Therefore, the coefficient of production (COP) during the air condition operation can be improved.

The cooled intermediate pressure refrigerant gas then passes through an absorption passage (not shown) formed in the upper supporting member 54, and then is absorbed into the low pressure chamber of the upper cylinder 38 from the absorption port (not shown). By the operation of the roller 46 and the valve 50, the second stage compression is performed and the refrigerant gas is subjected to high pressure and high temperature. Then, the high pressure and high temperature refrigerant gas is discharged from the high pressure chamber towards the discharging port (not shown) and passes through the discharging muffler 62 formed in the upper supporting member 54, to the external from the refrigerant discharging pipe 96. At this time, the refrigerant is compressed properly to a hyper critical pressure.

The refrigerant gas discharged from the refrigerant discharging pipe 96 flows from the four-way valve 161 into the outdoor heat exchanger 154, and then passes through the internal heat exchanger 160 after radiating heat in an air cooling manner at the outdoor heat exchanger 154 where the refrigerant gas takes heat from the low-pressure side refrigerant so as to be further cooled. In this way, since the supercooling degree of the refrigerant before reaching the expansion valve 156 can be increased, the air-condition ability of the refrigerant gas at the indoor heat exchanger 157 can be further improved.

The high-pressure side refrigerant gas, which is cooled by the internal heat exchanger 160, reaches the expansion valve 156. In addition, the refrigerant gas at the inlet of the expansion valve 156 is still in gaseous state. Due to a pressure reduction at the expansion valve 156, the refrigerant becomes a mixture comprising two phases, namely gas and liquid. With that mixed state, the refrigerant flows into the indoor heat exchanger 157. The refrigerant evaporates at the indoor heat exchanger 157 and then absorbs heat from the air. In this manner, a cooling effect is achieved for air-conditioning the interior space.

Afterwards, the refrigerant flows out of the indoor heat exchanger 157, and then passes through the internal heat exchanger 160 where the refrigerant takes heat from the high-pressure side refrigerant to accept a heating effect. In this manner, the refrigerant coming out of the indoor heat exchanger 157 can be surely gasified. Therefore, the liquid back phenomenon that the liquid refrigerant is absorbed into the compressor 10 can be firmly prevented without installing a receiver tank, and a disadvantage of damages caused by the liquid compression of the compressor 10 can be avoided.

The refrigerant heated by the internal heat exchanger 160 is absorbed from the refrigerant introduction pipe 94 into the first rotary compression element 32 of the compressor 10. The aforementioned cycle is repeatedly proceeded.

During the heating operation, the four-way valve 161 and the three-way valve 162 are switched by a control device (not shown) to positions as indicated by the dashed lines, and the refrigerant flows as indicated by the dashed lines in FIG. 2. As the stator coil 28 of the electrical motor element 14 is electrified through the wires (not shown) and the terminal 20, the electrical motor element 14 starts so as to rotate the rotor 24. By this rotation, the upper and the lower roller 46, 48, which are embedded to the upper and the lower eccentric parts 42, 44 that are integrally disposed with the rotational shaft 16, rotate eccentrically within the upper and the lower cylinders 38, 40.

In this way, the low pressure refrigerant gas, which passes through the absorption passage 60 formed in the refrigerant introduction pipe 94 and the lower supporting member 56 and is absorbed from the absorption port (not shown) into the low pressure chamber of the lower cylinder 40, is compressed due to the operation of the roller 48 and the valve 52, and then becomes intermediate pressure status. Thereafter, starting from the high-pressure chamber of the lower cylinder 40, the intermediate pressure refrigerant gas passes through a connection passage (not shown), and then discharges from the intermediate discharging pipe 121 into the sealed container 12. Accordingly, the interior of the sealed container 12 becomes intermediate pressure.

The intermediate pressure refrigerant gas within the sealed container 12 enters the refrigerant introduction pipe 92, then passes through an absorption passage (not shown) formed in the upper supporting member 54 of the second rotary compression element 34, as indicated by the dashed lines. Then, the refrigerant gas is absorbed into the low pressure chamber of the upper cylinder 38 of the second rotary compression element 34 from the absorption port (not shown). By the operation of the roller 46 and the valve 50, the second stage compression is performed and the refrigerant gas is subjected to a high pressure and high temperature. Then, the high pressure and high temperature refrigerant gas is discharged from the high pressure chamber towards the discharging port (not shown) and passes through the discharging muffler 62 formed in the upper supporting member 54, and finally, the high pressure and high temperature refrigerant gas is discharged to the external from the refrigerant discharging pipe 96. At this time, the refrigerant is compressed properly to a hyper critical pressure.

The refrigerant gas discharged from the refrigerant discharging pipe 96 passes through the internal heat exchanger 160 from the four-way valve 161, as indicated by the dashed lines in FIG. 2. At the internal heat exchanger 160, heat of the refrigerant is taken by the low-pressure side refrigerant, so as to be cooled. Afterwards, the refrigerant flows into the indoor heat exchanger 157 at which the refrigerant radiates heat. At this time, the refrigerant radiates heat to the ambient, and thereby, the interior room is heated. In addition, the refrigerant gas at the indoor heat exchanger 157 is still in gaseous state. Afterwards, due to a pressure reduction at the expansion valve 156, the refrigerant becomes a mixture comprising two phases, namely gas and liquid. With that mixed state, the refrigerant passes to the internal heat exchanger 160. The refrigerant evaporates at the internal heat exchanger 160, and then flows into the outdoor heat exchanger 154. At the outdoor heat exchanger 154, the refrigerant evaporates and absorbs heat from the air.

The refrigerant flows out of the outdoor heat exchanger 154, passes through the four-way valve 161, and then is absorbed from the refrigerant introduction pipe 94 into the first rotary compression element 32 of the compressor 10. The aforementioned cycle is repeatedly proceeded.

Therefore, during the heating operation, the refrigerant does not flow to the intermediate cooling circuit 150 by using the three-way valve 162. Because the refrigerant compressed by the first rotary compression element 32 is absorbed into the second rotary compression element 34 without being cooled, the refrigerant can be supplied to the indoor heat exchanger 157 under higher temperature status. Therefore, the heating ability of the refrigerant gas at the indoor heat exchanger 157 can be maintained during the heating operation.

In summary, the cooling capability of the refrigerant gas at the indoor heat exchanger 157 can be effectively improved during the air-conditioning operation, while the heating capability of the refrigerant gas at the indoor heat exchanger 157 can be maintained during the heating operation.

Furthermore, the expansion valve 156, serving as a depressurizing means, can be used in both the air-conditioning operation and the heating operation, but that is not to limit the scope of the present invention. For example, two valves can be used and are switched between the air-conditioning operation and the heating operation.

In addition, according to the embodiment of the present invention, a portion of the intermediate cooling circuit 150 is formed in a manner to pass through the outdoor heat exchanger 154, and the refrigerant passing the intermediate cooling circuit 150 is cooled by the outdoor heat exchanger 154. However, that configuration is not to limit the scope of the present invention. For example, an additional heat exchanger can be arranged in the intermediate cooling circuit 150 to cool the refrigerant that passes through the intermediate cooling circuit 150.

In the embodiments described above, carbon oxide is used as the refrigerant, but that is not to limit the scope of the present invention. For example, a variety of refrigerants, which can be used in a refrigerant cycling device whose high pressure side becomes a hyper critical pressure, can be applicable to the present invention.

As described in the aforementioned embodiments of the present invention, during the cooling operation, because the refrigerant discharged from the first rotary compression element can radiate heat in the intermediate cooling circuit to effectuate the cooling operation, the temperature in the sealed container can be avoided from rising.

In this manner, in the cooling operation, the cooling capability of the refrigerant gas at the heat exchanger is improved, and a desired evaporation temperature can be easily achieved without increasing the refrigerant cycling amount. Furthermore, since the power consumption of the compressor can be reduced, the coefficient of production (COP) during the air-condition (cooling) operation can be improved.

Therefore, the cooling capability of the refrigerant gas at the heat exchanger during the cooling operation can be effectively improved, while the heating capability of the refrigerant gas at the heat exchanger during the heating operation can be maintained.

According to another aspect of the present invention, during the cooling operation, because heat of the refrigerant that flows between the heat exchanger at the heat source side and the depressurizing means is taken by the refrigerant that flows between the heat exchanger at the user side and the compressor, the temperature of the refrigerant can be further reduced. Additionally, in the cooling operation, the cooling ability of the refrigerant gas at the heat exchanger of the user side can be further effectively improved.

Furthermore, since carbon dioxide is used as the refrigerant, the present invention can contribute for solving environment issues.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope of the invention.

What is claimed is:

1. A refrigerant cycling device, comprising:

a compressor, connected to at least two heat exchangers and a depressurizing means, for performing a cooling operation and a heating operation, wherein the compressor further comprises a first and a second rotary compression elements, and a refrigerant that is compressed and discharged by the first rotary compression element is introduced to the second rotary compression element;

an intermediate cooling circuit for radiating heat of the refrigerant discharged from the first rotary compression element;

a first valve device for opening a passage that allows the refrigerant discharged from the first rotary compression element passing through the intermediate cooling circuit before entering one of the two heat exchangers during the cooling operation; and a second valve device for inhibiting a heated refrigerant from the second rotary compression element to pass through the intermediate cooling circuit before entering one of the two heat exchangers during the heating operation.

2. The refrigerant cycling device of claim 1, wherein the heat exchangers are constructed by a first heat exchanger at a user side and a second heat exchanger at a heat source side, and the refrigerant cycling device further comprises an internal heat exchanger for cycling the refrigerant discharged from the first rotary compression element through the second heat exchanger at a heat source side, the depressurizing means and the first heat exchanger at a user side during the cooling operation, and for cycling the refrigerant discharged from the compressor through the first heat exchanger at a user side, the depressurizing means and the second heat exchanger at a heat source side during the heating operation, so as to perform a heat exchange between the refrigerant flowing between the depressurizing means and the second heat exchanger at a heat source side and the refrigerant flowing between the compressor and the first heat exchanger at a user side.

3. The refrigerant cycling device of claim 1, wherein carbon oxide is used as the refrigerant.

* * * * *